US005108358A

United States Patent [19]

Mounce

[11] Patent Number: 5,108,358

[45] Date of Patent: Apr. 28, 1992

[54] WASTE TAB STRIPPING APPARATUS FOR FIBERBOARD BLANK AND METHOD

[76] Inventor: Russell W. Mounce, 2500 Bethlehem Rd., Paris, Ky. 40361

[21] Appl. No.: 576,679

[22] Filed: Aug. 31, 1990

[51] Int. Cl.[5] ..... B31B 49/00

[52] U.S. Cl. ..... 493/373; 493/83; 493/342; 15/77

[58] Field of Search ..... 493/373, 342, 82, 83; 83/101; 225/93; 15/77

[56] References Cited

U.S. PATENT DOCUMENTS

| | | | |
|---|---|---|---|
| 3,112,851 | 12/1963 | Collins | 225/93 |
| 3,261,286 | 7/1966 | Hunter et al. | 15/77 X |
| 3,626,561 | 12/1971 | Luce et al. | 493/373 |
| 3,844,201 | 10/1974 | Eggert et al. | 493/342 |
| 4,113,243 | 9/1978 | Gregoire et al. | 493/342 |
| 4,366,736 | 1/1983 | Oosaki | 83/101 |
| 4,403,365 | 9/1983 | Hanson | 15/77 X |
| 4,613,321 | 9/1986 | Kesten et al. | 493/373 |
| 4,706,325 | 11/1987 | Michelson | 15/77 X |
| 4,774,737 | 10/1988 | Hanson | 15/77 X |
| 4,942,421 | 7/1990 | Gumbinner | 15/77 X |

FOREIGN PATENT DOCUMENTS 1041007 2/1965 United Kingdom ..... 15/77

*Primary Examiner*—Bruce M. Kisliuk
*Assistant Examiner*—John A. Marlott
*Attorney, Agent, or Firm*—King and Schickli

[57] ABSTRACT

A waste tab stripping apparatus used to form corrugated boxes from fiberboard blanks includes a mounting bracket adapted to retrofit the apparatus to a standard box-forming machine. A pair of counterrotating brushes are attached to the mounting bracket and are positioned so as to brush across the path of the blank. The brushes are longitudinally oriented so that their central axis extends at an angle substantially within the range of 5° to 17° relative to the direction of the path of the blank. One brush is positioned above the plane of blank and another brush is positioned below the plane of the blank. As the blank engages the stripping apparatus, the counterrotating brushes operate with a pinching force at the nip sufficient to strip the waste tab away toward the side edge of the blank. Pneumatically-powered motors are used to drive the brushes.

10 Claims, 2 Drawing Sheets

WASTE TAB STRIPPING APPARATUS FOR FIBERBOARD BLANK AND METHOD

TECHNICAL FIELD

The present invention relates generally to an apparatus for use in forming corrugated boxes from fibreboard, and more particularly, to a counter-rotating brush assembly used to remove waste tabs that have been cut in the fibreboard box blank.

BACKGROUND OF THE INVENTION

Automated preparation of corrugated boxes, or like transporting containers has become commonplace to meet the tremendous demands of bulk transportation of consumer products. There is an increasing need today for even swifter and more efficient formation of boxes for storing and shipping those products in order to keep the production costs as low as possible. Box-forming machines have been successfully utilized to maintain the pace in the past, but continued improvement in operation efficiency is desirable.

The standard box-forming machine, generally known in the art as a flexo-folder-gluer machine, operates on the fibreboard blank by scoring to increase flexibility and thus allow efficient folding, applying glue to the appropriate flaps/tabs for a secure adhesive bond and folding the blank to establish the final box configuration. As part of the forming process, relief areas are also cut from the blank so that when folded, the box presents a body with straight edges and allows the glued areas to be properly aligned for sealing.

While the rotary cutters of the present box-forming machine are ideally designed to completely sever the cut-out portion or waste tab that defines the relief area, from time to time the waste tab is not completely removed. It can be appreciated that an unremoved tab can disrupt the downstream operation of the box-forming machine. The waste tab may cause jamming during the downstream folding or gluing processes. Also, even if jamming is avoided, the waste tab may prevent the box from being properly folded, resulting in a deformed or unsealed, and thus unusable, box. There is thus presented a need to insure the complete removal of the waste tabs prior to further processing in order to maximize efficiency in the box-forming process.

An early approach used to form relief areas in blanks involves the use of cut-and-punch devices designed to cut and positively punch the cut tab off the blank. Such devices have met with only limited success. The box-forming machines using this intermittent method of forming necessarily are slower than machines using rotary cutters that operate on a continuous, non-stepped flow of blanks.

One approach that has been used with the rotary cutting machines in recent years to assure removal of the waste tab involves the use of a fixed brush positioned in the path of the blank downstream from the cutting station of the box-forming machine. As the blank travels across the stationary bristles of the brush, the sweeping action is supposed to strip any waste tab that remains hanging from the blank. While this design is generally effective, it occasionally fails to cleanly remove the tab causing a jam or improperly formed box. Also, the engagement between the bristles and the blank tends to retard the forward motion of the blank, causing the box blank to skew and further disrupting the forming process.

A somewhat similar idea for tab removal is presented in Canadian Patent 792,063 to Kirby et al, issued Aug. 13, 1968. A rotating brush is positioned transversely across the path of the blank downstream from the cutting station and rotates in a direction counter to the forward motion of the blank. Such a design provides a positive, more efficient sweeping action for removing a waste tab that might remain hanging by a fiber strand.

Thus, the transversely oriented, rotating brush has proven effective in removing some unsevered waste tabs, but still imparts a disadvantageous retarding and skewing action. It is also not always effective when the unsevered waste tab remains attached so as to lay in the plane of the blank. In addition, it does not efficiently remove tabs cut to define a relief area on the trailing edge of the blank. More specifically, an unsevered waste tab remains attached to the blank generally at the inside corner of the relief area. Therefore, as the blank travels in a forward direction with an unsevered waste tab on the trailing edge of the blank, a sweeping force applied against the direction of travel tends to fold the tab back up to the plane of the blank. Thus, it can be appreciated that the counterrotating action of the transverse brush simply folds the waste tab flat against the blank and is generally unreliable in the removal of tabs from the trailing edge.

Accordingly, there remains a need to efficiently strip or remove unsevered waste tabs from both the leading edge and trailing edge of a blank in a box-forming machine. The stripping apparatus would not substantially interfere with the forward motion of the blank as it travels downstream while insuring the removal of all remaining waste tabs to provide efficient downstream processing. The stripping apparatus would advantageously apply a stripping force laterally across the path of the blank to pull the tab sideways rather than folding the tab up into the plane of the blank. Such a waste tab stripping apparatus would be economical to manufacture and be easily retrofitted and integrated with the other components of the box-forming machine.

SUMMARY OF THE INVENTION

Accordingly, it is a primary object of the present invention to provide a waste tab stripping apparatus that more efficiently removes unsevered waste tabs cut from fibreboard blanks.

It is another object of the present invention to provide a waste tab stripping apparatus that does not impede or retard the forward motion of the blank or skew the blank as it proceeds from the cutting section to the gluing section of the box-forming machine.

It is a further object of the present invention to provide a waste tab stripping apparatus that is designed to remove an unsevered waste tab in a reliable fashion even from the trailing edge of the blank.

Another object of the present invention is to provide a waste tab stripping apparatus that reduces scoring fatigue on the blank as it operates to remove unsevered waste tabs.

It is an additional object of the present invention to provide a waste tab stripping apparatus that does not skew that blank along its path of travel.

It is an additional object of the present invention to provide a waste tab stripping apparatus whose stripping force is directed laterally across the path of travel of the blank.

Still another object of the present invention is to provide a waste tab stripping apparatus including opposed counterrotating brushes, the nip of which applies a pinching force to pull unsevered waste tabs away and directed toward the side edge of a fibreboard blank.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved waste tab stripping apparatus is provided. The stripping apparatus is designed to cooperate with a box-forming machine to remove unsevered waste tabs that remain hanging by a fiber strand following the cutting of the blank to form relief areas. The stripping apparatus is specifically designed to cooperate with a box-forming machine known generally in the art as a flexo-folder-gluer.

The waste tab stripping apparatus includes a mounting bracket that cooperatively couples to the box-forming machine. The preferred embodiment contemplates the use of a roller carriage on the mounting bracket that cooperates with a support bar formed integral with the machine. The bar is oriented transversely to the path of the fibreboard blank. Accordingly, the tab stripping apparatus translates transversely to accommodate operation on blanks of various widths.

A pair of counterrotating brushes are attached to the mounting bracket by brush support brackets. One brush is positioned below the plane of the blank and one brush is positioned above the plane of the blank. The brushes are composed of cylindrical heads to which synthetic bristles are attached. The brushes are oriented so that their axes are generally directed along, but slightly offset from the path of the blank. This disposition allows the brushes to rotate laterally across the path of the blank. The counterrotating action is directed towards the outer edge of the blank at the point of engagement. This creates a pinching force at the nip that is designed to pinch or pull an unsevered waste tab that is not cleanly removed by the cutter assembly. The waste tabs are carried away by a waste tab conveyor to an accumulating position for disposal or recycling.

The brushes are independently driven by separate motors. In the preferred embodiment, turbine motors operate by means of pneumatic actuation.

As described above, the axes of the brushes are offset slightly from the direction of the path of the blank. It can be appreciated that the angled offset disposition of the brushes allows for a greater contact area between the bristles and the blank as it passes through the nip compared with a brush orientation exactly aligned with the direction of the blank. This provides greater efficiency in the pinching force and resulting removal of any unsevered waste tabs that are engaged by the stripping apparatus. In the preferred embodiment, the brushes are oriented so that their axes are angled at substantially 10° from the direction of the path of the blank. However, the brushes may be angled to a greater or lesser degree depending upon space limitations, force requirements, or tab width. It has been found that the brushes operate to effectively remove unsevered waste tabs when oriented at angles substantially between 5° and 17° from the direction of blank travel.

In operation, a blank is fed into the box-forming machine and directed to the cutter assembly. The cutter assembly forms slots in the blank and cuts the waste tab to form the appropriate relief areas. Under ideal conditions, the cutter assembly completely severs and removes the waste tab that is cut in the blank. However, in actual operation, some tabs are not completely removed but rather remain hanging by a few fibers or strands, typically at the inside corner of the waste tab. In addition, some tabs are held by a sufficient number of strands to remain in the plane of the blank, or to be folded back against the blank rather than hanging. The tab stripping apparatus is specifically designed to remove all of the unsevered waste tabs in both of the above-described situations.

It should be emphasized that as the blank passes through the stripping apparatus, the counterrotating brushes exert a transverse force across the blank, generally transverse to its path of travel that is substantially greater than can be obtained with prior art devices. The nip of the rotating brushes pinch the unsevered tabs with sufficient force to pull them towards the side edge and away from the blank even when several strands are holding the tab. The waste tabs are positively flipped by the tab stripping apparatus away from the blank so they are cleanly removed. As a result, the tabs do not tend to be caught on top of the blank where upon feeding into the gluer assembly may still cause a problem.

It can be appreciated that the tab stripping apparatus operates effectively on blanks that have tabs cut and removed to form relief areas on both the leading and trailing edges, unlike a transversely oriented brush assembly as described above. It allows the blank to travel forwardly through the box-forming machine substantially unimpeded and reduces the opportunity for scoring fatigue to occur in the blank.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figures 1, 2, 3:
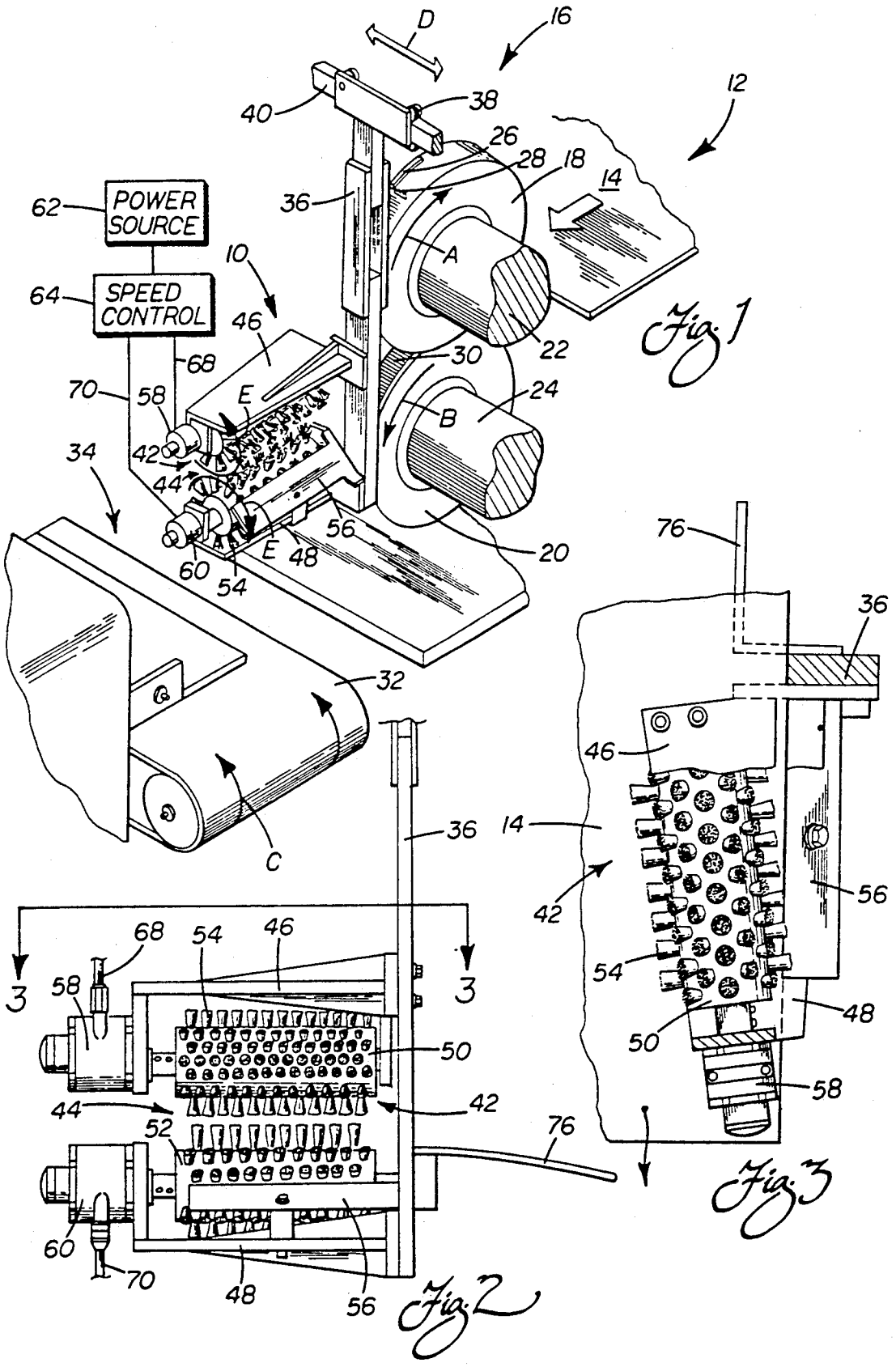
FIG. 1 is a perspective view of a portion of a box-forming machine showing the waste tab stripping apparatus of the present invention positioned between the cutter assembly and the gluer assembly.
FIG. 2 is a side elevational view of the waste tab stripping apparatus of the present invention.
FIG. 3 is a partially broken away top view taken along the lines 3—3 of FIG. 2.

Reference is made to the drawing and in particular to FIG. 1 wherein is shown a waste tab stripping apparatus 10 according to the teachings of the present invention incorporated in a box-forming machine 12. The tab stripping apparatus 10 is specifically adapted to be utilized in machines known in the art as flexo-folder-gluer machines, one manufacturer of which is Langston Corporation.

The box-forming machine is utilized to transform a flat rectangular fibreboard blank 14 into a box that is used to hold articles for storage or transportation. The box-forming machine of the flexo-folder-gluer type includes several stations through which the fibreboard blank 14 travels sequentially during the forming process. Each station comprises an assembly that carries out a specific function.

In a typical flexo-folder-gluer machine, the virgin blank, made of corrugated fibreboard stock, travels along a feed path and first encounters a printing station (not shown) where the appropriate identifying and descriptive legend is printed thereon. The printed blank continues to a scoring station (not shown) where the blank is scored or indented along lines that eventually form edges after the blank is folded into a final box structure.

The scored blank proceeds along the feed path to a cutting station (see FIG. 1) where relief areas are formed in the blank by cutting waste tabs therefrom. The relief areas allow the blank to be folded so that the sides properly fit together when folded into the final box structure.

Following the cutting station, the cut blank travels to a gluing station (see FIG. 1 also) where an adhesive, such as hot melt glue, is applied to the flaps/tabs that are to be folded over upon themselves and against the box panels to actually form the box shape. The blank then proceeds to the final folding station where the blank is actually folded into the completed box.

Under ideal conditions, the waste tabs cut to form the relief areas are completely severed from the blank at the cutting station. However, inconsistencies in the corrugated stock and the dulling of the cutting blades over time often leads to unsevered tabs. Accordingly, a back-up mechanism such as a waste tab stripping apparatus is often placed between the cutting station and the gluing station to insure that all of the waste tabs cut to form relief areas are removed. This is the specific purpose to which the tab stripping apparatus 10 of the present invention is directed.

The tab stripping apparatus 10 is shown in FIG. 1 as it is properly positioned along the feed path of the blank 14 between the cutting station and the gluing station of the box-forming machine 12. A slotting/cutting assembly 16 is positioned at the cutting station upstream from the stripping apparatus 10. The slotting/cutting assembly 16 includes at least one pair of rotary heads. The top or male head 18 and bottom or female head 20 cooperate to slot and cut the blank 14 to form the desirable relief areas. The heads 18, 20 are carried on shafts 22, 24, respectively, and are driven to counterrotate. In addition to cutting, the heads impart forward motion to the blank 14 as it passes therebetween to direct it downstream for further processing. This is best seen in FIGS. 4A-4C where the male head 18 is shown as rotating clockwise (action arrow A) and the female head 20 is shown as rotating counterclockwise (action arrow B).

The male head 18 carries one or more sets of cutting blades, i.e. a slotting knife 26 and a cutting knife 28. The slotting knife 26 is utilized to make a longitudinal incision in the blank 14 and the cutting knife 28 makes a lateral incision from the inner corner of the longitudinal incision to the outer edge of the blank 14.

The knives 26, 28 are specifically designed to cooperate with a urethane anvil 30 formed on the outer periphery of the female head 20. More particularly, the knives 26, 28 are operatively positioned on the male head 18 so that as the blank 14 passes between the heads 18, 20, the knives 26, 28 press into the urethane anvil 30. In doing so, the blank 14 passing between the knives 26, 28 and anvil 30 is cut substantially completely through while the urethane material of the anvil 30 remains operationally unharmed. In most cases, the knives 26, 28 completely sever the waste tab so that it could drop free of the blank, and the desired relief area is formed without the tab causing a liability in the downstream operations. However, as described above, the tab stripping apparatus 10 is utilized as a back-up mechanism to remove any unsevered waste tabs (see, for example, tabs 72 and 74 in FIG. 4A-4C).

Figure 4A:
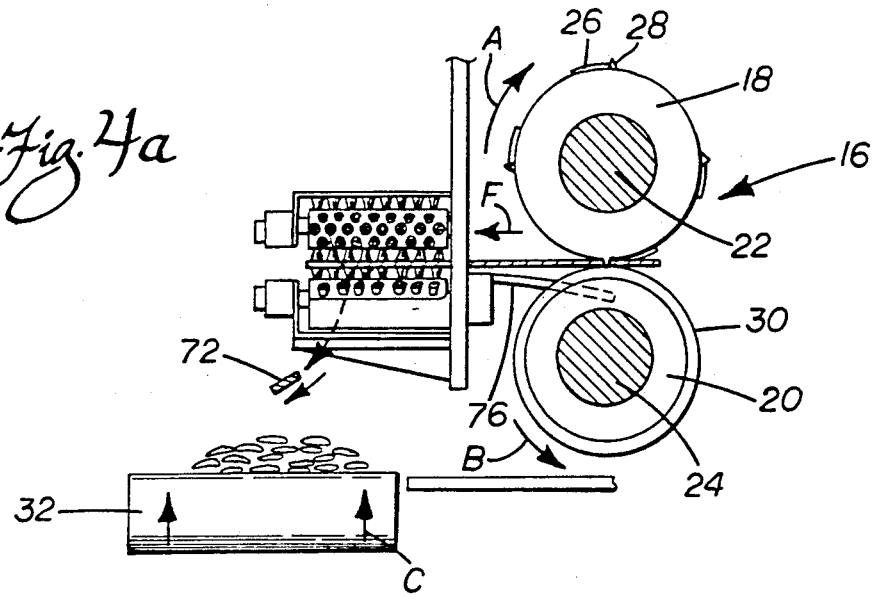
FIGS. 4A-4C are partially broken away side elevational views showing the operation of the waste tab stripping apparatus in removing unsevered waste tabs remaining following the cutting operation.
Figure 4B:
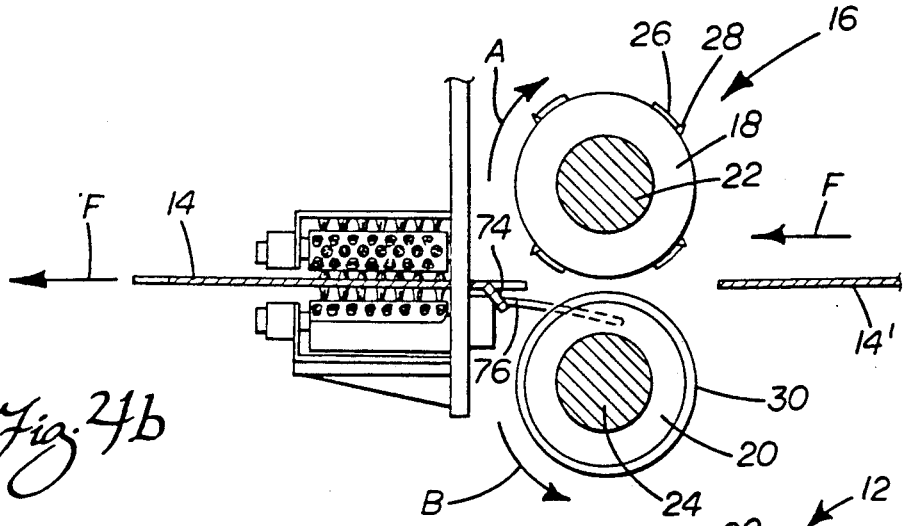
Figure 4C:
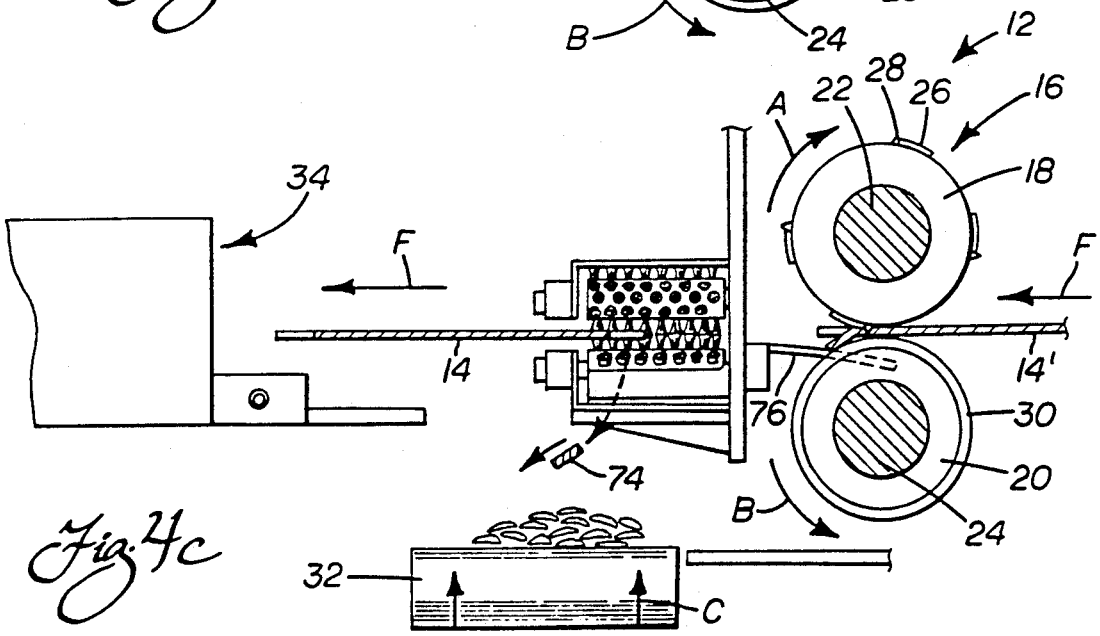

The waste tabs fall to a scrap conveyor 32 that runs transversely (as indicated by action arrows C) to the direction of the path of the blank 14 (see FIG. 4A). The scrap conveyor 32 carries the waste tabs to an accumulator (not shown) for later disposal or recycling. After the blank 14 passes through the stripping apparatus 10 it proceeds to the gluing assembly, generally indicated as 34, at the gluing station.

The stripping apparatus 10 includes a mounting bracket 36 that mounts to the box-forming machine 12. In the preferred embodiment, the mounting bracket includes rollers 38 that engages a support bar 40 that is formed rigidly integral with the frame of the box-forming machine 12. The bar 40 is oriented transversely to the path of travel of the blank 14. This mounting arrangement allows the mounting bracket 36 carrying the stripping apparatus 10 to translate laterally (as shown by action arrow D) to accommodate different cutting heads 18, 20 and blanks of varying width. Thus the stripping apparatus 10 can be precisely placed to engage the tabbed area of the blank as it passes by. Furthermore, the particular structure of the mounting bracket 36 can be designed to properly retrofit virtually any existing box-forming machine 12.

In an important aspect of the invention, the tab stripping apparatus includes opposed brushes 42, 44 attached to the mounting bracket 36 by brush support brackets 46, 48, respectively. The upper brush 42 is positioned above the plane of the blank 14 and the lower brush 44 is positioned below the plane of the blank 14 (see FIGS. 4A and 4B). Accordingly, when operative as further described below, the brushes 42, 44 are positioned to engage the top and bottom surfaces, respectively of the blank 14 at the nip. The brackets 46, 48 are adjusted so that bristles 54 of the brushes are flexed the proper amount to pull the tabs 72, 74 free of the blank 14, while not inducing sufficient friction to cause skewing of the blank as it moves along the feed path.

The brushes 42, 44 are comprised of cylindrical brush heads 50, 52 to which the bristles 54 are firmly attached. The bristles 54 are preferably made of synthetic material for durability. In the preferred embodiment, the bristles 54 are formed in small clusters that are positioned in rows along the length of the brush heads 50, 52. However, it can be appreciated that other patterns of bristles may be utilized. An effective alternative design contemplates having the bristles in a helical pattern around the cylindrical brush heads 50, 52.

The brushes 42, 44 are driven to counterrotate with respect to each other, as shown by action arrows E in FIG. 1. The counterrotating action of the brushes 42, 44, in conjunction with the brush orientation as further described below, acts to efficiently remove all waste tabs 72, 74 that remain on the blank 14 after operatively passing through the slotting/cutting assembly 16.

Prior art brushes incorporated into prior box-forming machines to remove waste tabs are disclosed as being oriented transversely to the direction of the path of the blank, as described above. While such a design is generally recognized as being effective in removing unsevered waste tabs on the leading edge of a blank, it leaves much to be desired when a relief area is being formed on the trailing edge of the blank (see tab 74 in FIG. 4B). The waste tab 74 cut from the trailing edge of the blank 14 is cut in a opposite manner to the tab on the leading edge. More particularly, on the leading edge, the slotting knife 26 engages the blank 14 initially to form the longitudinal slot beginning at the leading edge. Then the cutting knife 28 cuts through the blank 14 from the inner corner of the slot to the side edge of the blank 14. In contrast, to form the relief area on the trailing edge, the cutting knife 28 first engages the blank 14 and then the slotting knife 26 slots longitudinally from the inner corner of the transverse cut towards the back edge of the blank.

Since unsevered waste tabs tend to hang by fiber strands at the inner corner, it can be appreciated that a stationary (or rotating) brush that is positioned transversely to the path of the blank inherently has difficulty removing a tab 74 from the trailing edge of the blank 14. Rather than sweeping a tab from the trailing edge away, a transverse brush simply tends to push the hanging tab 74 back into the relief area in the plane of the blank 14 or flat against the surface of the blank.

According to an important aspect of the present invention, the counterrotating brushes 42, 44 are oriented so that their axes are generally in the direction of the path of the blank (but slightly offset as more particularly described below), rather than transverse to it. This allows the bristles 54 to brush across the path of the blank 14, as opposed to against the path of the blank. Thus, the force imparted by the brushes 42, 44 to remove unsevered waste tabs is directed towards the side edge of the blank 14. Accordingly, the tab stripping apparatus 10 of the present invention including the opposed brushes 42, 44 that brush across the top and bottom surfaces of the blank 14 operates to remove unsevered waste tabs from both the leading and trailing edges with equal effectiveness. The counterrotation of the brushes 42, 44 that occurs during engagement with the blank 14 essentially creates a pinching force at the nip to pull the waste tab 72, 74 out and flip it away from its attachment.

The pinching force is also effective in removing unservered waste tabs 72, 74 that hang from several strands so as to remain generally in the plane of the blank 14. The orientation of the brushes providing for brushing action across the blank 14 also facilitates forward travel without impeding or retarding the blank. This results in no perceptive skewing of the blank that could disrupt the downstream processing and actual forming of the box. The inventive design also reduces scoring fatigue by practically eliminating the force exerted directly against the entire leading edge of the blank 14 at the point of engagement.

In the preferred embodiment, a stripper guide or shield 56 is shown mounted adjacent the bottom brush support bracket 48 to assist in directing the waste tabs 72, 74 for collection. The stripper guide 56 acts to direct the waste tabs 72, 74 to the scrap conveyor 32 below the stripping apparatus 10. It can be appreciated that a similar guide may be attached to the upper brush support bracket 46, or alternatively a singular shield may be designed to cover the entire area directly along the side of the brushes 42, 44 where the waste tabs 72, 74 are flipped or thrown.

In another important aspect of the invention, the brushes 42, 44 are disposed at an angle slightly offset from the direction of the path of the blank, as shown in FIG. 3. It can be visualized that if the brushes 42, 44 are situated so that their axes are exactly parallel to the direction of the path of the blank 14, the lateral surface contact area of the nip between the brushes 42, 44 and the blank 14 would be very limited. It can be further appreciated that the strongest pinching and pulling force is exerted by the bristles 54 at the nip along the vertical center line of the brush heads 50, 52. Accordingly, by disposing the brushes 42, 44 at a slight angle to the direction of the path of the blank 14, a greater lateral surface contact area between the bristles 54 and the blank 14 is provided. This allows the optimal pinching force to be spread over a greater lateral area so that relatively wide tabs 72, 74 may be effectively removed.

In the preferred embodiment, the brushes 42, 44 are disposed at an offset angle of approximately 10° from the direction of the path of the blank 14. However, the brushes 42, 44 have been shown to operate effectively when disposed at any of a variety of angles between a range of 5° to 17°. Thus, the stripping apparatus 10 is adapted to accommodate a wide range of box blanks.

The brushes 42, 44, are rotated by individual motors 58, 60. While the motors 58, 60 may be powered by any known means, in the preferred embodiment, the motors 58, 60 are pneumatically powered.

A power source 62 directs the air to a speed control 64. This provides the air with the proper amount of throttling to control the speed. The air is then split into lines 68, 70 to be carried to the motors 58, 60 to drive the brushes 42, 44.

Reference is now made to FIGS. 4A–4C sequentially showing the cutting of the blank 14 and subsequent removal of the unsevered waste tabs 72, 74 by the tab stripping apparatus 10. As the leading edge of the blank 14 reaches the slotting/cutting assembly 16, first the slotting knife 26 and then the cutting knife 28 make their respective cuts into the blank 14. When the slotting/cutting assembly 16 does not completely sever the tab 72 from the leading edge of the blank, it generally hangs from its inside corner. The counterrotating action of the heads 18, 20 (action arrows A and B) push the blank 14 forwardly towards the tab stripping apparatus 10 (see action arrow F). A blank guide bar 76 may be attached to the mounting bracket 36 to prevent the blank 14 from sagging as it approaches the stripping apparatus 10 and to guide the blank 14 in a plane between the brushes 42, 44.

As the leading edge of the blank 14 passes through the brushes 42, 44 of the stripping apparatus 10, the waste tab 72 is pinched away from the blank and directed to the scrap conveyor 32 below.

The trailing edge of the blank 14 is next acted upon by the slotting/cutting assembly 16. As is particularly shown in FIG. 4B, first the cutting knife 28 and then the slotting knife 26 make their respective cuts in the trailing edge of the blank.

When the waste tab 74 cut along the trailing edge of the blank 14 is not completely severed, it also generally hangs at its inside corner. However, as described above, the counterrotating action of the brushes 42, 44 in conjunction with their orientation with respect to the path of the blank 14 effectively pinches away the waste tab 74 and directs it laterally with a positive flipping action to the scrap conveyor 32, as shown in FIG. 4C.

At substantially the same time, the slotting/cutting assembly 16 is acting on the leading edge of the next succeeding blank 14' and the operation is repeated. After the blank 14 passes through the stripping apparatus 10, it proceeds to the gluing assembly 34 as shown in FIG. 4C. A guide rail (not shown) may be provided between the stripping apparatus 10 and the gluing assembly 34 to maintain the direct feed path of the blank 14 as it proceeds for downstream processing.

In summary, numerous benefits are obtained by the use of the stripping apparatus 10 of the present invention, which includes the counterrotating brushes 42, 44 that are oriented to brush across the path of the fibreboard blank 14 rather than against it. This provides for more efficient removal of unsevered waste tabs 72, 74 from both the leading edge and the trailing edge of the blank 14 and obviates the possibility of damage to the blank 14, such as scoring fatigue and prevents skewing along the feed path. The brushes 42, 44 are offset by a slight angle to the path of the blank 14 to increase the lateral surface contact area between the brushes 42, 44 and the blank 14. The tab stripping apparatus 10 advantageously can be retrofitted to standard box-forming machines.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A waste tab stripping apparatus in combination with a machine that forms the tab on a fibreboard blank moving along an ambient feed path and wherein the tab tends to hang by a fiber strand, comprising:

bracket means for mounting said waste tab stripping apparatus to said machine;

rotating brush means attached to said bracket means, said brush means disposed so as to rotate with a brushing action sufficient to break said strand in a direction laterally across the path of said blank; and drive means for rotating said brush means;

whereby said brush means breaks said strand and removes said waste tab to facilitate further process in the forming operation.

2. The waste tab stripping apparatus of claim 1, wherein said brush means includes one brush positioned above the plane defined by said blank and one brush positioned below the plane defined by said blank so as to engage said blank in opposing relation.

3. The waste tab stripping apparatus of claim 2, wherein said opposing brushes rotate in a counterrotating manner.

4. The waste tab stripping apparatus of claim 3, wherein said brushes are longitudinally disposed so that their central axes are substantially within a range of 5° to 17° relative to the direction of the path of said blank.

5. The waste tab stripping apparatus of claim 4, wherein said brushes are longitudinally disposed so that their central axes are substantially 10° relative to the direction of the path of said blank.

6. The waste tab stripping apparatus of claim 5, wherein said drive means includes motors driven by pneumatic power.

7. A method of removing an unsevered waste tab cut in a fibreboard blank moving along an ambient feed path and wherein the tab tends to hang by a fiber strand, comprising the steps of:

placing rotating brush means in a tab stripping position so as to rotate with a bushing action sufficient to break said strang in a direction laterally across the path of said blank; and directing said blank along said path from a tab cutting position to said tab stripping position;

whereby said strand is broken and said waste tab is removed to facilitate further processing of said blank.

8. The method as in claim 2, further including the step of:

directing said blank from said tab stripping position downstream for further processing.

9. The method as in claim 8, wherein the brush means positioning step further includes:

placing the axis of said brush means to extend longitudinally substantially within a range of 5° to 17° relative to the direction of the path of said blank.

10. The method of claim 9, wherein said brush positioning step includes the step of:

placing the axis of said brush means to extend longitudinally substantially 10° relative to the direction of the path of said blank.

* * * * *